US006863586B2

(12) United States Patent
Okuyama

(10) Patent No.: US 6,863,586 B2
(45) Date of Patent: Mar. 8, 2005

(54) MANUFACTURING METHOD FOR A SEALING PLUG USED IN SEALING AN ARC TUBE, SEALING PLUG, AND DISCHARGE LAMP

(75) Inventor: Hikoji Okuyama, Hirakata (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 100 days.

(21) Appl. No.: 10/271,949

(22) Filed: Oct. 15, 2002

(65) Prior Publication Data

US 2003/0080684 A1 May 1, 2003

(30) Foreign Application Priority Data

Oct. 17, 2001 (JP) ..... 2001-319526
Jun. 3, 2002 (JP) ..... 2002-161218

(51) Int. Cl.[7] ..... H01J 9/00
(52) U.S. Cl. ..... 445/26; 445/29; 445/43; 313/625
(58) Field of Search ..... 445/26, 29, 43; 313/624, 625

(56) References Cited

U.S. PATENT DOCUMENTS 5,468,168 A * 11/1995 Balaschak et al. ..... 445/26
5,742,123 A * 4/1998 Nagayama ..... 313/623
6,020,685 A * 2/2000 Wei et al. ..... 313/625
6,190,728 B1 2/2001 Suzuki et al.

FOREIGN PATENT DOCUMENTS

| | | |
|---|---|---|
| JP | 05-290810 | 11/1993 |
| JP | 11-171590 | 6/1999 |
| JP | 2000-315456 | 11/2000 |

* cited by examiner

*Primary Examiner*—Joseph Williams
*Assistant Examiner*—German Colón

(57) ABSTRACT

A sealing plug used for sealing an arc tube, and formed from a plurality of sintered layers. The sealing plug is obtained by conducting a slurry preparation step of preparing slurries corresponding to each layer of the sealing plug by mixing together a tungsten powder, a silica powder, an organic binder, an organic solvent, and a dispersant; a preform manufacturing step of manufacturing layers of a preform by repeating the process of dipping the metal lead wire into the slurries with the metal lead wire in a perpendicular position, and drying the slurry adhering when the metal lead wire is removed; and a sintering step of sintering the manufactured preform.

17 Claims, 8 Drawing Sheets

FIG.3

(wt%)

| | Molybdenum | Silica | Organic Binder | Organic Solvent | Dispersant |
|---|---|---|---|---|---|
| First Slurry | 100 | 0 | 3 | 20 | 1 |
| Second Slurry | 93 | 7 | 3 | 25 | 1 |
| Third Slurry | 82 | 18 | 3 | 30 | 1 |
| Fourth Slurry | 60 | 40 | 3 | 40 | 1 |
| Fifth Slurry | 0 | 100 | 3 | 40 | 1 |

FIG.7

(wt%)

| | Molybdenum | Silica | Alumina | Manganese | Organic Binder | Organic Solvent | Dispersant |
|---|---|---|---|---|---|---|---|
| Alloy Slurry | 80 | | | 20 | 3 | 20 | 1 |
| Alumina Slurry | | 4 | 96 | | 3 | 20 | 1 |
| Alloy Slurry | 80 | | | 20 | 3 | 20 | 1 |

MANUFACTURING METHOD FOR A SEALING PLUG USED IN SEALING AN ARC TUBE, SEALING PLUG, AND DISCHARGE LAMP

This application is based on applications no. 2001-319526 and no. 2002-161218 filed in Japan, the contents of which are hereby incorporated by reference.

BACKGROUND OF THE INVENTION

1. Field of the Invention

The present invention relates to a manufacturing method for a sealing plug used in sealing an arc tube, the sealing plug, and a discharge lamp that uses the sealing plug.

2. Related Art

In discharge lamps, and in particular high-pressure mercury lamps, the electrodes and the external lead wire for supplying power to the electrodes are generally connected to one another via a metallic foil mounted within the arc tube. This is to prevent the light-emitting material filled within the arc tube from leaking out under conditions of high-temperature and high-pressure.

This structure is satisfactory when the discharge lamp is not frequently operated. However, when the frequency with which the discharge lamp is operated increases, cracking may occur due to thermal stress resulting from a difference in the coefficients of thermal expansion of the metallic foil and the arc tube. The light-emitting material within the arc tube then leaks out as a result of the cracking, and the life of the lamp is thus shortened.

In order to resolve this problem, a method of sealing the ends of the arc tube using a sealing plug has been suggested (see application no. 5-290810 filed in Japan).

This sealing plug is obtained by sintering a preform formed from a plurality of layers positioned concentrically around a metal lead wire that supplies power to the electrodes within the arc tube of a high-pressure mercury lamp. Each layer, in a direction from the inner to the outer layers, includes less of the metal lead wire component and more of the arc tube component. As such, the coefficient of thermal expansion of the sealing plug gradually changes, from the inner layers to the outer layers, from having a value close to the coefficient of thermal expansion of the metal lead wire to having a value close to the coefficient of thermal expansion of the arc tube. Consequently, even if the temperature within the arc tube increases, the thermal stress generated between the metal lead wire and the arc tube is gradually relieved in the intermediate layers of the sealing plug, and thus the cracking described above can be prevented.

Manufacturing methods for such a sealing plug are disclosed in the application cited above. One method includes forming the layers of a preform by repeating the process of applying slurries (made from the powders of components of the metal lead wire and the arc tube, as well as organic binders, organic solvents, dispersants, and the like) to the metal lead wire and drying the applied slurries, and then sintering the preform thus formed. Another method includes manufacturing green sheets corresponding to the layers formed from the slurries, wrapping the green sheets around the metal lead wire to form a preform, and sintering the preform thus formed.

Although the above methods for manufacturing the sealing plug are effective in the prevention of cracking, there are problems relating to the quality and manufacturability of the sealing plug.

Specifically, in the method according to which layers are formed by applying slurries to the metal lead wire and drying the applied slurries, problems relating to the size and shape of the sealing plug (e.g. variations in the amount of slurry applied; variations in the thickness of individual layers), and the layers not been concentrically positioned with respect to the metal lead wire, can occur, and as a result it is difficult to manufacture sealing plugs of an even quality.

On the other hand, in the method according to which layers of green sheets are formed around the metal lead wire, it is extremely difficult to wrap the green sheets evenly around the metal lead wire, which has a small diameter, and to layer the green sheets so that the ends meet exactly (i.e. without the ends either overlapping or not meeting). Thus this method is of little practical use.

SUMMARY OF THE INVENTION

In view of the above issues, a first object of the present invention is to provide a manufacturing method for a sealing plug used in sealing an arc tube, the method allowing for a high-quality sealing plug to be manufactured that is consistent in size and shape, and for improvements in the manufacturability of the sealing plug to be realized.

A second object of the present invention is to provide a sealing plug used in sealing an arc tube, and that is of high quality and consistent in size and shape.

A third object of the present invention is to provide a discharge lamp in which a sealing plug used in sealing an arc tube can be readily mounted in the arc tube.

A manufacturing method provided to achieve the first object is for a sealing plug used in sealing an arc tube, the sealing plug being formed by sintering a preform structured from a plurality of layers, the layers of the preform being layered around an outer circumference of a metal lead wire that supplies power to electrodes within the arc tube, so that the layers are substantially concentric with respect to the metal lead wire. The manufacturing method includes a slurry preparation step of preparing slurries used in forming the layers of the preform, the slurries corresponding one-to-one with the layers; and a preform manufacturing step of manufacturing the preform by dipping the metal lead wire into the slurry used to form an inner-most layer and drying the slurry adhering to the metal lead wire, and repeating the dipping and drying sequentially for the slurries used to form a second layer to an outer-most layer.

According to this method, the metal lead wire is dipped into the slurries, and thus, in addition to being able to readily adhere the slurries to the metal lead wire and layers already formed around the metal lead wire, the manufacturability of the sealing plug can be improved. In the preform manufacturing step, for example, the metal lead wire is dipped into and removed from the slurries with its central axis in a perpendicular position, and as a result the slurries adhere concentrically with respect to the metal lead wire.

It is thus possible to obtain a preform in which the various layers are of even thickness, and to readily manufacture a high-quality sealing plug that is consistent in size and shape. Furthermore, because the external diameter and shape of the sealing plug is consistent, a regular clearance between the arc tube and the sealing plug inserted into the arc tube can be achieved, and this allows the sealing plug to be effectively mounted within the arc tube.

The first object may also be achieved by a manufacturing method for a sealing plug used in sealing an arc tube, the sealing plug being formed from a plurality of sintered layers made of different components, the sintered layers being layered around an outer circumference of a metal lead wire, so that the layers are substantially concentric with respect to the metal lead wire. The manufacturing method includes a slurry preparation step of preparing slurries that include sintered layer components for each layer of the sealing plug; a preform manufacturing step of manufacturing a preform by dipping a core, which is substantially the same shape as the metal lead wire, into the slurry used to form an innermost layer and drying the slurry adhering to the core, and repeating the dipping and drying sequentially for the slurries used to form a second layer to an outer-most layer; a preliminary sintering step of sintering the preform and burning-off the core by pyrolysis; and a main sintering step of inserting the metal lead wire in a space created by the burning-off of the core, and sintering the preliminarily sintered preform, so as to bond together the metal lead wire and the preform.

According to this method, a core is dipped into the slurries, and thus the slurries adhere evenly to the core. As a result, layers of even thickness throughout can be achieved, and a high-quality sealing plug that is consistent in size and shape can be readily manufactured. Moreover, because the external diameter and shape of the sealing plug is consistent, a regular clearance between the arc tube and the sealing plug inserted into the arc tube can be achieved, and this allows the sealing plug to be effectively mounted within the arc tube.

Furthermore, because the metal lead wire, which is inserted into the space created after the core has been burned-off, and the preform, which has undergone preliminary sintering, are bonded together (i.e. coalesced) by sintering, the bonding of the metal lead wire and the preform to one another is extremely strong. As a result, it is possible to obtain a sealing plug of extremely high quality. Moreover, because the core is dipped into the slurries, the slurries adhere readily to the core, and because the core is burned-off by pyrolysis when the preform undergoes preliminary sintering, and the metal lead wire, which is inserted into the space created by the burning-off of the core, and the preliminary sintered preform are sintered together, the bonding of the metal lead wire and the preform can be readily achieved. By adjusting the size and external diameter of the core with respect to the metal lead wire, it is possible to achieve an optimal space between the inserted metal lead wire and the preform in the main sintering step, and thus cracking does not readily occur between the metal lead wire and the preform at a time of the main sintering.

The second object can be achieved by a sealing plug used in sealing an arc tube, and that is manufactured according to one of the above methods.

The third object can be achieved by a discharge lamp in which a sealing plug, manufactured using one of the above methods, seals an arc tube.

BRIEF DESCRIPTION OF THE DRAWINGS

These and other objects, advantages and features of the invention will become apparent from the following description thereof taken in conjunction with the accompanying drawings that illustrate specific embodiments of the present invention.

In the drawings:

FIG. 3 shows a component compound of slurries for a preform according to embodiment 1;

FIG. 7 shows a component compound of slurries for a bonding layer according to embodiment 3.

DETAILED DESCRIPTION OF THE PREFERRED EMBODIMENTS

Embodiments of a high-pressure mercury lamp that uses a sealing plug according to the present invention will now be described with reference to the drawings.

1. Embodiment 1

1-1. Structure of a High-Pressure Mercury Lamp

Figure 1:
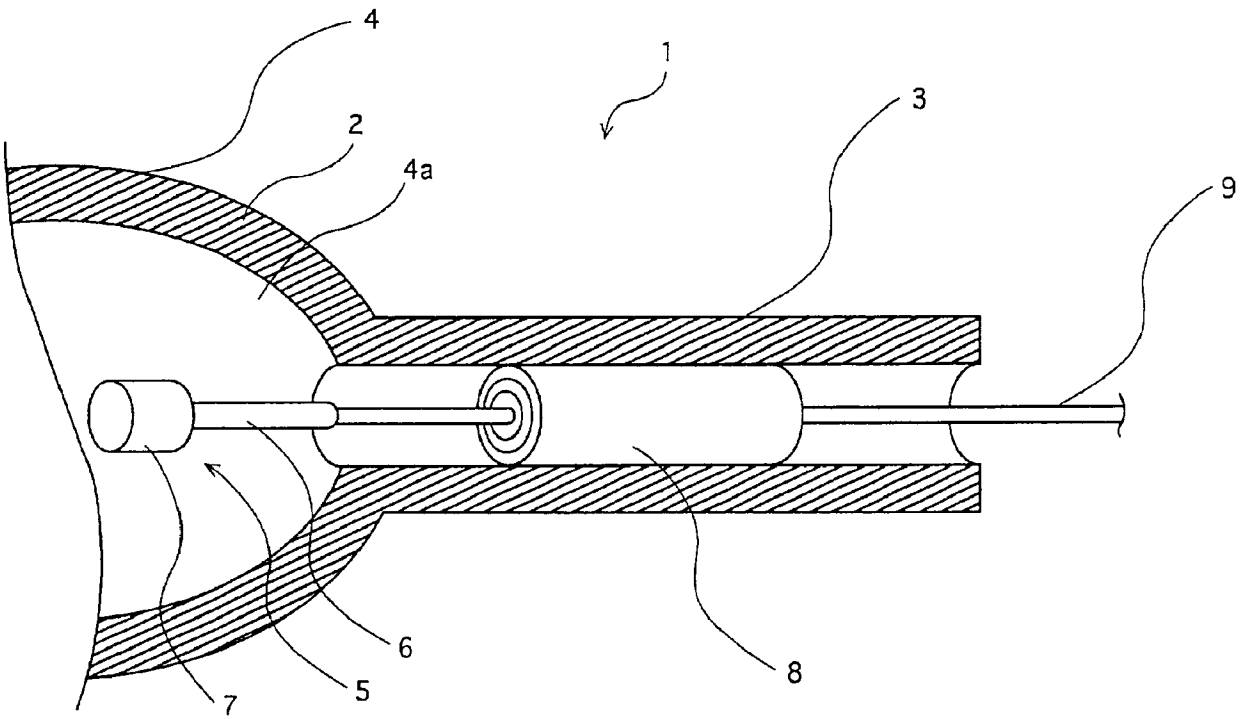
FIG. 1 is a schematic perspective view of a structure of a high-pressure mercury lamp according to an embodiment 1 of the present invention.

FIG. 1 is a schematic perspective view of the structure of a high-pressure mercury lamp 1 that uses a sealing plug according the present invention. FIG. 1 shows a cross-section of the lamp so as to reveal an internal structure. High-pressure mercury lamp 1 (hereafter "lamp 1") according to the present embodiment is symmetrical, and only one of the symmetrical halves (i.e. the right half) is depicted in FIG. 1.

Lamp 1 includes an arc tube 4 formed from an approximately spherical main tube 2, and thin tubes 3 provided at either end of main tube 2. Arc tube 4 is, for example, made of silica glass, and a pair of electrodes 5 is disposed in an arc space 4*a* within the arc tube so that one electrode faces the other.

Electrodes 5 are formed from electrode rods 6 made of tungsten, and electrode coils 7 made of tungsten and disposed on an end of electrode rods 6. Furthermore, arc space 4*a* is, for example, filled with mercury, which is a light-emitting material, a rare gas, such as argon, krypton, or xenon, which acts as a starter, and a halogen material such as iodine or bromine.

Here, the halogen material acts to suppress the blackening of the inside of main tube 2 as a result of the so-called "halogen cycle", in which tungsten vaporized from electrode coils 7 during luminescence returns to electrode coils 7.

Furthermore, main tube 2 and thin tubes 3 structuring arc tube 4 are made of the same material and formed as one according to the present embodiment, although main tube 2 and thin tubes 3 may be formed of different materials and fitted together after being formed.

In each thin tube 3 is mounted an substantially concentric sealing plug 8 that seals the inside of arc tube 4. After sealing plugs 8 are inserted into thin tubes 3, the outside of thin tubes 3 is heated to 1700° C.–1900° C. according to a conventional lamp sealing method that uses a burner, a laser, or similar heat source, and sealing plugs 8 are affixed within arc tube 4. Here, the inside of thin tubes 3 is melted to the outside of sealing plugs 8 along a length of the sealing plugs. (Note: for ease of comprehension, only one half of the symmetrical arc tube 4 will be referred to below).

Figure 2:
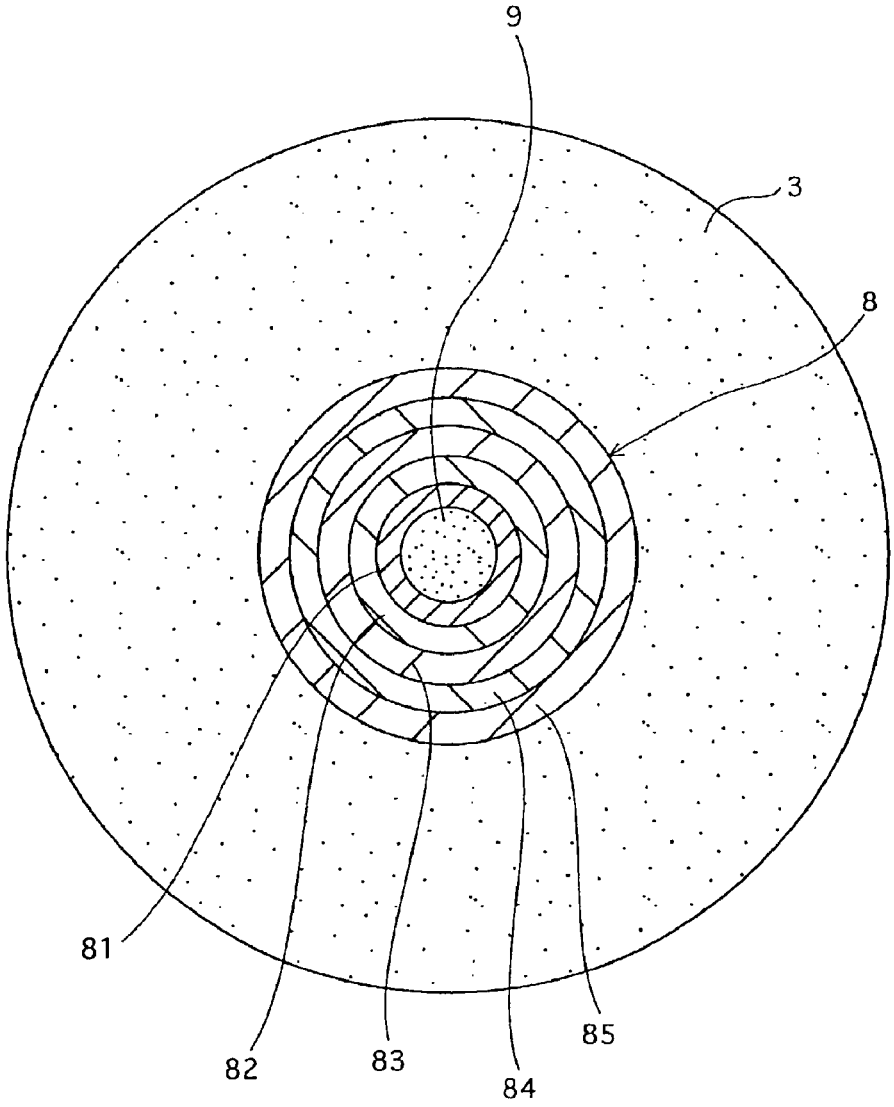
FIG. 2 is a vertical cross-sectional view of a thin tube of an arc tube according to embodiment 1.

FIG. 2 is a vertical cross-sectional view of a section of thin tube 3 that is sealed by sealing plug 8.

As shown in FIG. 2, sealing plug 8 is obtained by sintering a preform structured from a plurality of layers (e.g. five layers) positioned concentrically around a metal lead wire 9 made of molybdenum. Sealing plug 8 is structured from at least two materials. These include the molybdenum component from which metal lead wire 8 is made, and the silica component from which arc tube 4 is made.

So as to distinguish between the various layers of the preform and the various layers of sealing plug 8, hereafter the former will be referred to as "preform layers", and the later will be referred to as "sintered layers".

Sealing plug 8 is, as described above, formed from five sintered layers. The inner-most layer (i.e. closest to metal lead wire 9) is a first sintered layer 81, and the outer-most layer (i.e. contacting with the inside of thin tube 3) is a fifth sintered layer 85. The sintered layers between layers 81 and 85 are, from inner to outer, a second sintered layer 82, a third sintered layer 83, and a fourth sintered layer 84.

Sintered layers 81 to 85 of sealing plug 8 include more molybdenum component and less silica component the closer the layer is to metal lead wire 9. Conversely, sintered layers 81 to 85 include more silica component and less molybdenum component the closer the layer is to arc tube 4. This structure allows for the thermal stress relieving properties of sealing plug 8 to be enhanced.

1-2. Sealing Method for the Arc Tube 1-2-1. Manufacture of the Sealing Plug

A) Slurry Manufacturing Process

First, the slurries corresponding to sintered layers 81 to 85 are prepared using a conventional method such as a ball mill method. A first slurry is used for sintered layer 81, a second slurry is used for sintered layer 82, a third slurry is used for sintered layer 83, a fourth slurry is used for sintered layer 84, and a fifth slurry is used for sintered layer 85.

FIG. 3 shows a component compound of the first to fifth slurries.

As shown in FIG. 3, each slurry 10 (i.e. the first to fifth slurries in FIG. 3) is formed from a mixture of a molybdenum powder (i.e. component of metal lead wire 9), a silica powder (i.e. component of arc tube 4), an organic binder, an organic solvent, a dispersant, and the like. As mentioned above, the preparation of slurries 10 is conducted using a conventional method such as the ball mill method.

Here, the molybdenum and silica in FIG. 3 is a fine powder, and a particle size of these powders is determined appropriately according to a thickness of each sintered layer and the positioning and sintering conditions of the sintered layers.

The organic binder may be a common binder used in forming ceramics, examples of which include polyvinyl alcohol, acrylic, and polyvinyl butyral. In the present embodiment, polyvinyl butyral is used. Furthermore, butyl acetate is used for the organic solvent, and an ammonium carboxylic acid is used for the dispersant.

Here, as shown in FIG. 3, increasing the silica component results in increases in the compounding ratio of the organic solvent. That is, the compounding ratio of the organic solvent in the first to fifth slurries increases from the inner to the outer layers. This is because the viscosity of each slurry 10 increases when the silica component in the slurry is raised, and thus to appropriately adjust the viscosity of each slurry it is necessary to increase the compounding ratio of the organic solvent. The viscosity of each slurry 10 is adjusted in order to control the amount of the slurry adhering to metal lead wire 9 when the metal lead wire is dipped in the slurry.

B) Preform Manufacturing Process

Figure 4:
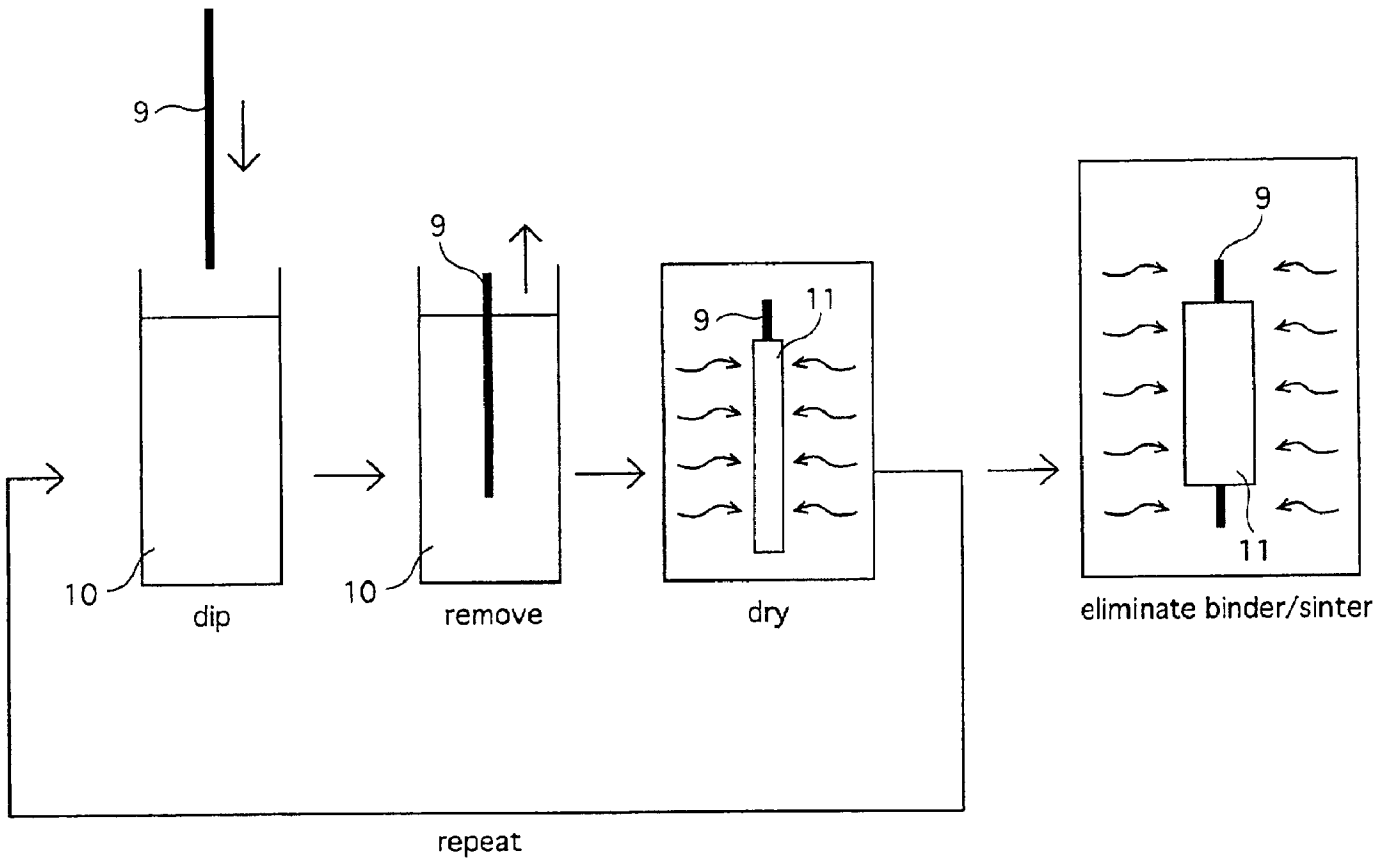
FIG. 4 is a schematic view of a manufacturing process for a sealing plug according to embodiment 1.

FIG. 4 is a schematic view of a manufacturing process for the sealing plug according to the present embodiment. As shown in FIG. 4, metal lead wire 9 (diameter 0.4 mm) is dipped into first slurry 10 with a central axis of the metal lead wire in a perpendicular position. Metal lead wire 9 is dipped in the slurry up to a predetermined position of the metal lead wire. Metal lead wire 9 is then removed from the slurry at a predetermined speed (e.g. 10 cm/min), with its central axis maintained in a perpendicular position. A first preform layer is then formed by drying the removed metal lead wire under predetermined conditions (e.g. 70° C. for 3 min). Here, the speed at which metal lead wire 9 is removed from the slurry is determined appropriately in accordance with a thickness of the preform layer and a viscosity of the slurry.

Next, the second to fifth slurries 10 are used in the stated order to layer the second to fifth preform layers, respectively, around metal lead wire 9 according to the above method, so as to manufacture a preform 11 (external diameter approx.1.3 mm) in which the ratio of components in each layer varies in a radial direction of the preform. Here, with respect to the second to fifth slurries 10, metal lead wire 9 is dipped so that the surface of the slurry is level with the top end of the first preform layer. This allows the outward-facing surface of the top end of preform 11 to be maintained approximately level.

Next, an end of preform 11 (the bottom end in FIG. 4) is cut-off using a cutter or the like, so that preform 11 is shortened to a predetermined length. Here, metal lead wire 9 is not cut and is exposed at the bottom end of preform 11. Also, sections may be cut off both ends of preform 11 to achieve the predetermined length, again without cutting metal lead wire 9. In this case, the outward-facing surface of both ends of preform 11 can be made level.

C) Sintering Process

Next, the preform cut to the predetermined length is dried in a non-oxidizing atmosphere (e.g. a nitrogen atmosphere) at 500° C. for 4 hours, as a result of which the binder is eliminated (i.e. herein "binder elimination process" or "preliminary sintering process"). Then, in a vacuum, the preform is sintered in an electric oven at 1600° C. for 30 minutes, as a result of which sealing plug 8 (i.e. sintered member of preform 11) is manufactured. Here, a heating apparatus that uses a laser, a discharge plasma, or similar heat source, may be used in the sintering instead of an electric oven.

1-2-2. Electrode Joining Process

A method of joining electrode 5 (note: as mentioned above, only one half of the symmetrical arc tube is referred to here) includes preparing electrode rod 6, fusing one end of electrode rod 6 to one end of metal lead wire 9, and welding the other end of electrode rod 6 to electrode coil 7.

1-2-3. Sealing Process

Sealing plug 8, in which electrode 5 has been joined to metal lead wire 9 by the above method, is inserted into the end of thin tube 3 such that electrode coil 7 is positioned in arc space 4*a*. Heat in a range of 1700° C. to 1900° C. is then applied to the outside of thin tube 3 in accordance with a conventional lamp sealing method that uses a burner, a laser or similar heat source, and the inside of thin tube 3 is melted to the outside of sealing plug 8 along a length of the sealing plug, thus affixing the sealing plug within arc tube 4.

According to this manufacturing method, it is possible to readily manufacture a cylindrical sealing plug 8. In other words, because metal lead wire 9 is immersed in each of slurries 10 up to a predetermined position of the metal lead wire, and then removed from the slurry at a regular speed, each of slurries 10 readily adheres to metal lead wire 9. Moreover, since metal lead wire 9 is dipped into and removed from each of slurries 10 with its central axis in a perpendicular position, slurries 10 adhere around the outside of metal lead wire 9 at an even thickness.

The viscosity of each of slurries 10 is optimized so that the slurry adhering to metal lead wire 9 does not run, and thus, in addition to being able to reduce the occurrence of uneven thickness throughout a single preform layer, it is possible for each of the preform layers to be formed concentrically around metal lead wire 9. Moreover, because the sintering is conducted using a preform (i.e. preform 11) that is concentric with respect to metal lead wire 9, it is possible to readily obtain a sealing plug (i.e. sealing plug 8) that is concentric and whose sintered layers 81 to 85 have a regulated thickness. As a result, when sealing plug 8 is to be sealed within thin tube 3, the sealing process is facilitated by the outer circumference of sealing plug 8 substantially matching the inner circumference of thin tube 3. Moreover, because the components of the outer circumference of sealing plug 8 closely match the components of thin tube 3, the joining together is facilitated, and no gap remains between sealing plug 8 and thin tube 3.

Furthermore, changes to the thickness of each of the preform layers can be readily achieved by adjusting the viscosity of the slurries and the speed at which metal lead wire 9 is removed from the slurries. Adjustments to the viscosity of slurries 10 is mainly conducted by varying the compounding ratio of the organic solvent.

Furthermore, sealing plug 8 thus manufactured has a multi-layer structure in which the coefficient of thermal expansion of the inner most layer approaches the coefficient of thermal expansion of metal lead wire 8, the coefficient of thermal expansion of the outer most layer approaches the coefficient of thermal expansion of thin tube 3 of the arc tube, and the coefficient of thermal expansion of the intermediate layers gradually changes from the inner to the outer layers. According to this structure, sealing plug 8 expands to substantially the same extent as metal lead wire 9 and thin tube 3, even during conditions of high temperature and high pressure within arc tube 4 when lamp 1 is turned on, and thus cracking does not readily occur.

2. Embodiment 2

Figure 5:
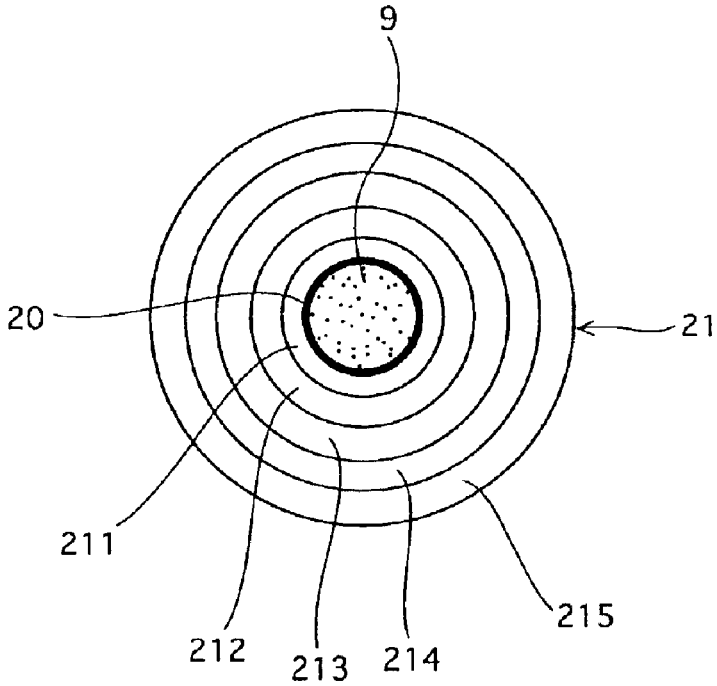
FIG. 5 is a cross-sectional view of layers of a preform according to an embodiment 2 of the present invention.

FIG. 5 is a cross-sectional view of layers of a preform according to an embodiment 2.

The sealing plug according to embodiment 2 of the present invention has the same structure as sealing plug 8 shown in embodiment 1, although a difference lies in the fact that, in the present embodiment, a preform 21 prior to sintering includes a varnish layer 20 between metal lead wire 9 and the preform of embodiment 1.

Varnish layer 20 is made of a readily decomposable organic material, and when preform 21 is formed, layer 20 is provided, as shown in FIG. 5, between metal lead wire 9 and a first preform layer 211, although layer 20 is eliminated during the sintering of the sealing plug.

Here, "readily decomposable" refers to the fact that a component decomposes easily when heat is applied, and thus varnish layer 20 decomposes under the heat of the binder elimination process. Here, the numbering 212 to 215 shows the second to fifth preform layers of preform 21.

The manufacturing method for the sealing plug that includes varnish layer 20 will now be described. Firstly, a varnish using in forming varnish layer 20 is prepared. The method of forming layers on metal lead wire 9 is the same as that used in embodiment 1. Thus metal lead wire 9 is dipped into and removed from the varnish used in forming varnish layer 20 with the central axis of the metal lead wire in a perpendicular position, and the varnish adhering to the outside of metal lead wire 9 is dried so as to form a varnish layer of approximately 5 $\mu$m in thickness around metal lead wire 9.

Next, as in embodiment 1, preform 21 is manufactured by layering first to fifth preform layers 211~215 around metal lead wire 9 in the stated order, and an end of preform 21 is cut-off to reduce preform 21 to a predetermined length. After an end of preform 21 has been cut-off to expose metal lead wire 9, the binder is eliminated and preform 21 is sintered under the same conditions as in embodiment 1, as a result of which preform 21 is bonded to metal lead wire 9 to obtain the sealing plug.

Varnish layer 20 positioned between metal lead wire 9 and first preform layer 211 is formed from an organic material and decomposes during the binder elimination process, which creates a space between metal lead wire 9 and first preform layer 211 prior to sintering. When preform 21 is sintered, the space created by the decomposition of varnish layer 20 allows for differences in the rate of expansion and contraction of metal lead wire 9 and the sealing plug during and after the sintering, and thus a sealing plug without defects can be readily realized in the sintering process.

In other words, when the sintering is complete and the temperature is reduced to room temperature, the sealing plug thus obtained contracts to a greater extent than metal lead wire 9, and thus if varnish layer 20 is not provided and first preform layer 211 is in contact with metal lead wire 9 when preform 21 is sintered, cracking can occur when the temperature is reduced after the sintering because of the sealing plug not being able to fully contract in a radial direction.

As in the present embodiment, however, when a preform that included a varnish layer between metal lead wire 9 and first preform layer 211 is sintered, a space is created between metal lead wire 9 and first preform layer 211 prior to sintering as a result of the decomposition of the varnish layer during a binder elimination process, and the sealing plug obtained from the sintering process is thus able to fully contract in a radial direction when the temperature is reduced subsequent to the sintering. Consequently, the occurrence of cracking after the sintering process, as was the case in the prior art, can be prevented, and thus by providing varnish layer 20, it is possible to improve the production yield factor in comparison to when the preform is sintered without a varnish layer being provided.

3. Embodiment 3

3-1. Structure

Figure 6:
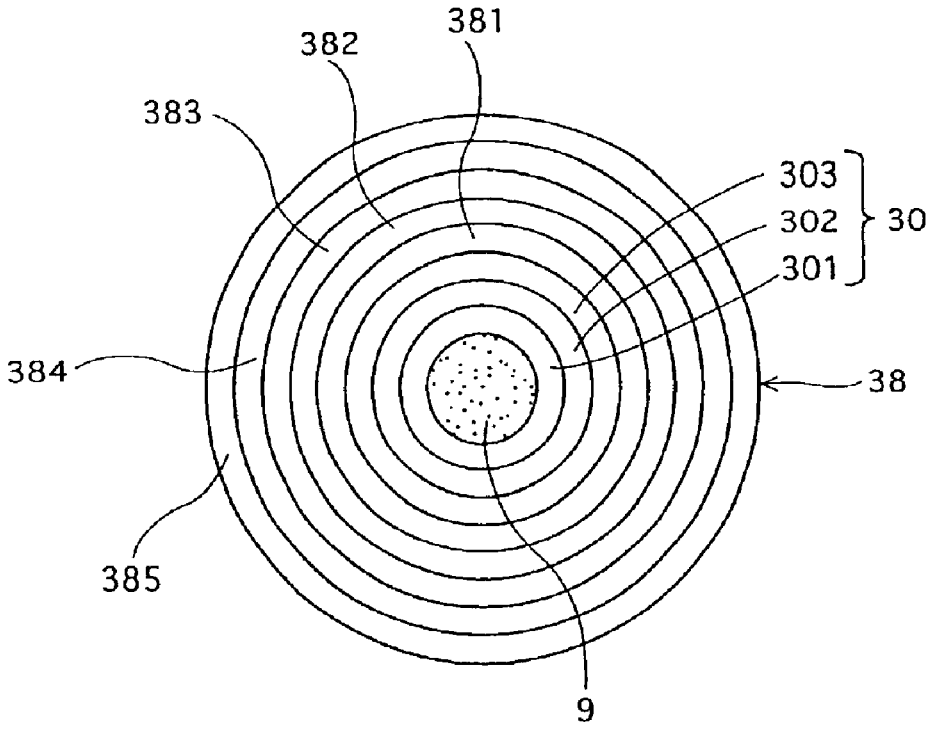
FIG. 6 is a cross-sectional view of layers of a preform according to an embodiment 3 of the present invention.

FIG. 6 is a cross-sectional view of layers of a preform showing an embodiment 3 of the present invention. A sealing plug 38 according to embodiment 3 includes a bonding layer 30 that, as shown in FIG. 6, is provided between metal lead wire 9 and a sealing plug structured as in embodiment 1, so as to bond together metal lead wire 9 and sealing plug 38.

Bonding layer 30 includes an alloy sintered layer 301 formed around the outside of metal lead wire 9 and including manganese and molybdenum, a alumina sintered layer 302 formed around the outside of alloy sintered layer 301 and including silica and alumina, and an alloy sintered layer 303 formed around the outside of alumina sintered layer 302 and of substantially the same composition as alloy sintered layer 301. The manganese in alloy sintered layers 301 and 303 is a metallic material having a lower melting point than a metallic material (molybdenum) forming a main component of metal lead wire 9 and the inner layers of sealing plug 38.

Here, as with the layers of the sealing plug, the various layers of bonding layer 30 before and after sintering will be distinguished by referring to the pre-sintering layers as "alloy preform layers" (i.e. corresponding to layers 301, 303) and "alumina preform layer" (i.e. corresponding to layer 302), and the post-sintering layers as "alloy sintered layers" (i.e. layers 301 and 303) and "alumina sintered layer" (i.e. layer 302).

3-2. Manufacturing Method

FIG. 7 shows a component compound of slurries for the various layers of the bonding layer.

Alloy slurries for alloy sintered layers 301 and 303, and an alumina slurry for alumina sintered layer 302 are prepared according to the compounds shown in FIG. 7. Here, the slurries for the sintered layers of the sealing plug to be layered around the outside of bonding layer 30 are the same as in embodiment 1, and are prepared according to the compounds shown in FIG. 3.

The slurries prepared for sintered layers 301 to 303 of bonding layer 30 are then layered around metal lead wire 9 in the same manner as in embodiment 1. That is, metal lead wire 9 is dipped in the alloy slurry for alloy sintered layer 301 so that the alloy slurry adheres to the outside of metal lead wire 9. The alloy slurry adhering to metal lead wire 9 is then dried to form an alloy preform layer (i.e. corresponding to layer 301).

Next, metal lead wire 9 is dipped in the alumina slurry for alumina sintered layer 302 so that the alloy preform layer around metal lead wire 9 is entirely immersed in the alumina slurry. The alumina slurry adhering to the outer surface of the alloy preform layer is then dried to form the alumina preform layer (i.e. corresponding to layer 302).

Metal lead wire 9 is then dipped in the alloy slurry for alloy sintered layer 303 so that the alumina preform layer around metal lead wire 9 is entirely immersed in the alloy slurry, and an alloy preform layer (i.e. corresponding to layer 303) is formed on the outer surface of the alumina preform layer.

Next, the first preform layer (corresponding to a first sintered layer 381 after sintering) to the fifth preform layer (corresponding to a fifth sintered layer 385 after sintering) are layered, as in embodiment 1, in the stated order around the metal lead wire on which the alloy and alumina preform layers have been formed, and as a result a preform used in manufacturing sealing plug 38 is formed. An end of the preform is then cut-off (without cutting metal lead wire 9) so as to reduce the preform to a predetermined length, and metal lead wire 9 is thus exposed.

The obtained preform then undergoes a binder elimination process in a non-oxidizing atmosphere (e.g. nitrogen atmosphere) at 500° C. for four hours, and this is followed by a sintering process in a hydrogen atmosphere whose dew point has been adjusted to −5° C., and at a temperature (e.g. 1600° C. for 30 min) greater than or equal to the melting point of manganese. Sealing plug 38 formed from the sintered preform is obtained as a result.

Here, in sealing plug 38 obtained as described above, the manganese in both of the alloy preform layers provided under and above, respectively, the alumina preform layer, oxidizes due to vaporization within the hydrogen atmosphere during the sintering, and becomes manganese monoxide. Due to the manganese monoxide as well as the alumina and silica in the alumina preform layer, alumina sintered layer 302 is formed as a glass layer ($MnO+Al_2O_3+SiO_2$) that is highly fixative.

Furthermore, due to the sintering, the molybdenum in the alloy preform layers precipitates to the surface of the alloy preform layers near the alumina preform layer, and as a result, liquid phase sintering occurs in alloy sintered layer 301 due to the melting of the manganese in layer 301. This allows the wetting properties of alloy sintered layer 301 with metal lead wire 9 to increase greatly, and the adhesion between alloy sintered layer 301 and metal lead wire 9 to be strengthened. Also, the melting of the manganese in alloy sintered layer 303 causes the liquid phase sintering of the molybdenum precipitated from the alloy preform layer corresponding to layer 303 with the molybdenum in the first preform layer (i.e. corresponding to first sintered layer 381) of the preform, and this allows a strong adherence to be obtained between these two layers. As a result, sealing plug 38 is bonded strongly to metal lead wire 9 via bonding layer 30.

Here, the compounding ratio of the manganese in alloy sintered layers 301 and 303 of bonding layer 30 is, as shown in FIG. 7, set at 20 wt % according to the present embodiment, although it may be set in a range of 1 wt % to 30 wt % inclusive. If the compounding ratio of the manganese is set at 0 wt %, bonding layer 30 is solid-state sintered rather than liquid phase sintered, and thus the bonding force cannot be improved. Conversely, if the compounding ratio of the manganese is set to be greater than 30 wt %, the manganese in alloy sintered layers 301 and 303 vaporizes when the temperature within arc tube 4 increases after high-pressure mercury lamp 1 is turned on, and this can cause the luminescence color of high-pressure mercury lamp 1 to change.

Here, the compounding ratio of the silica in alumina sintered layer 302 is, as shown in FIG. 7, set at 4 wt % according to the present embodiment, although it may be set in a range of 1 wt % to 5 wt % inclusive. If the compounding ratio of the silica is set at 0 wt %, the formation of bonding layer 30 as a glass layer cannot be achieved, whereas if the compounding ratio of the silica is greater than 5 wt %, the mechanical strength of alumina sintered layer 302 is reduced.

After the binder elimination process, the preform is sintered in a hydrogen atmosphere whose dew point has been adjusted to −5° C. according to the present embodiment, although the dew point of the hydrogen atmosphere may be set in a range of −20° C. to −5° C. inclusive. If the dew point of the hydrogen atmosphere is set in a range of −20° C. to −5° C. inclusive, the manganese in the alloy preform layers reacts selectively to the vaporization within the hydrogen atmosphere, and oxidizes to become manganese monoxide.

4. Embodiment 4

According to embodiment 1 above, slurries 10 used in forming the preform layers are adhered to the surface of metal lead wire 9 and layers already formed around metal lead wire 9. In comparison, in the present embodiment, the preform is formed using a core 40 instead of metal lead wire 9. The core is then burned-off in a preliminary sintering process of the preform, and metal lead wire 9 is inserted into the space created by the burning off of the core. The preform with metal lead wire 9 inserted therein is then sintered so as to bond together the preform and metal lead wire 9.

Figure 8:
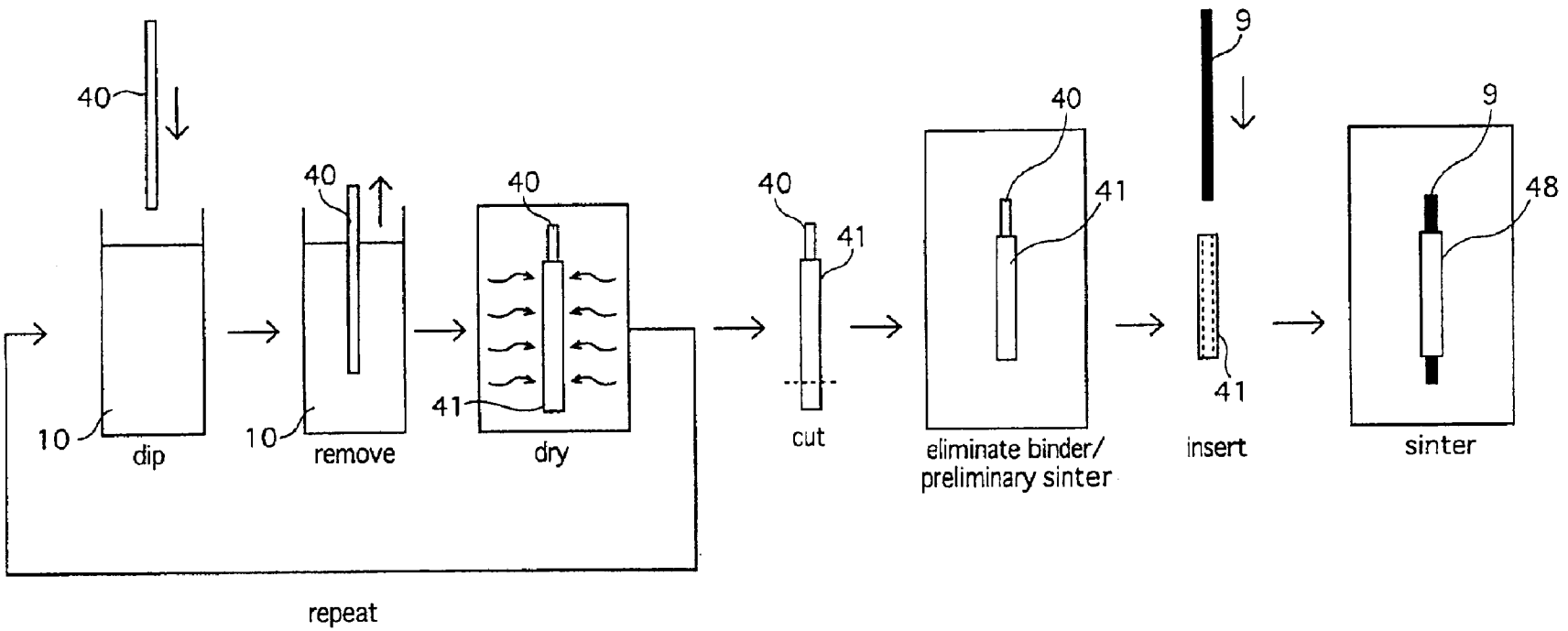
FIG. 8 is a schematic view of a manufacturing process for a sealing plug according to an embodiment 4 of the present invention.

FIG. 8 is a schematic view of a manufacturing process for a sealing plug 48 of the present embodiment.

4-1. Slurry Manufacturing Process

First, five slurries 10 corresponding to the sintered layers are prepared as in embodiment 1 above. Here, the components of each of slurries 10 are the same as in embodiment 1 shown in FIG. 3. The molybdenum, silica, organic binder and the like used in the slurries are also the same as those used in embodiment 1. Moreover, the ordering in which the slurries are adhered, as well as a thickness of the various layers is also the same as in embodiment 1.

4-2. Preform Manufacturing Process

As shown in FIG. 8, core 40, which is made of a paraffin wax and has a diameter of 0.5 mm, is firstly dipped in first slurry 10 with a central axis of the core positioned perpendicular to the surface of the first slurry. Core 40 is immersed in the first slurry up to a predetermined position of the core. Core 40 is then removed from the first slurry at a predetermined speed (e.g. 10 cm/min) and with its central axis in a perpendicular position. Next, the removed core 40 is dried under predetermined conditions (e.g. 60° C. for 3 min) to form a first preform layer. Here, the speed at which core 40 is removed from the slurry is determined appropriately in accordance with a viscosity of each of the slurries as well as the required thickness of each of the preform layers.

Next, the second to fifth slurries are used to form the remaining preform layers, as a result of which is manufactured a preform 41 having a diameter of 1.3 mm and in which the ratio of structural components changes in a radial direction.

Here, core 40 is dipped in the second to fifth slurries so that the surface of each slurry is level with the top end of the first preform layer. This allows the outward-facing surface of the top end of preform 41 to be kept level.

Next, a tip (i.e. of the bottom end in FIG. 8) of preform 41 thus obtained is cut-off using a cutter or the like, so that preform 41 is reduced to a predetermined length (e.g. 15 mm), and so that core 40 is exposed. Here, the core may also be cut.

Furthermore, both ends of preform 41 (including the core) may be cut-off to achieve the predetermined length. In this case, since both ends of preform 41 are cut-off, it is possible to achieve a preform in which the outward-facing surface of both ends is horizontally level.

4-3. Preliminary Sintering Process

Next, preform 41 cut to a predetermined length undergoes heat processing (i.e. the preliminary sintering process) in a non-oxidizing atmosphere (e.g. a nitrogen atmosphere) at 700° C. for four hours, as a result of which the core is burned-off and the binder in slurries 10 is eliminated.

4-4. Main Sintering Process

Next, metal lead wire 9 having a diameter of 0.45 mm is inserted into the space created by the burning-off of the core during the preliminary sintering of preform 41, and then in a vacuum, preform 41 (i.e. with metal lead wire 9 inserted therein) is sintered in an electric oven at 1600° C. for 30 minutes, as a result of which preform 41 is sintered and bonded to metal lead wire 9 to complete the manufacture of sealing plug 48.

In the manufacturing method for sealing plug 48 according to the present embodiment as described above, core 40 is dipped in slurries 10, and as a result the slurries can be adhered evenly to core 40. This allows for the thickness of the layers of sealing plug 48 to be uniformized, and the size and shape of the sealing plug to be stabilized.

Furthermore, since preform 41 with metal lead wire 9 inserted into the space created by the burning-off of core 40, is sintered in order to bond the together metal lead wire 9 and sealing plug 48 (i.e. obtained from the sintering of preform 41), it is possible to form an extremely strong bond between the metal lead wire and the sealing plug. As a result, it is possible to obtain a sealing plug of extremely high quality.

Moreover, since core 40 is dipped into slurries 10, slurries 10 can be readily adhered to core 40. Furthermore, the preliminary sintering of preform 41 allows core 40 to be burned-off by pyrolysis, and preform 41 with metal lead wire 9 inserted into the space created by the burning-off of core 40 is sintered in order to bond together sealing plug 48 and metal lead wire 9, and thus it is possible to readily bond together the sealing plug and the metal lead wire, and improve the manufacturability of sealing plug 48 in comparison to prior art manufacturing methods for sealing plugs.

In particular, because in the preform manufacturing process, core 40 is dipped into and removed from slurries 10 with a central axis of the core positioned perpendicular to the surface of the slurries, slurries 10 can be adhered concentrically around core 40, and a preform can be obtained in which each layer is even in thickness throughout. Furthermore, since the viscosity of the slurries is optimized so that the slurries adhering to core 40 do not run, it is possible to greatly reduce the occurrence of uneven thickness among the preform layers.

Here, variations in the thickness of the preform layers may be achieved by adjusting the viscosity of the slurries and the speed at which core 40 is removed from the slurries. Here, adjustment to the viscosity of the slurries is mainly conducted by varying the compounding ratio of the organic solvent.

Furthermore, because the bottom end of preform 41 is cut-off in a cutting-off process that follows the preform manufacturing process, and metal lead wire 9 is then inserted into and bonded to the cut preform 41 so that part of metal lead wire 9 is exposed, the various processes of manufacturing high-pressure mercury lamp 1, such as joining electrode 5 to an end of metal lead wire 9 using a conventional method, are facilitated.

Furthermore, because a readily decomposable organic material is used in core 40, the process of eliminating core 40 is facilitated, and the manufacturability of sealing plug 48 is further improved.

Variations and Related Matters

The above description focuses on various embodiments of the present invention, although the content of the present invention is, of course, not limited to the specific examples given in the above embodiments, and variations may be effected, examples of which are described below.

(1) Preform Manufacturing Process

In the process for manufacturing preforms 11, 21, and 41 in the above embodiments, either metal lead wire 9 (embodiments 1–3) or core 40 (embodiment 4) is dipped into and removed from slurries 10 with a central axis of metal lead wire 9 or core 40 in a perpendicular position, and as a result slurries 10 are adhered to metal lead wire 9 or core 40, and to layers already formed around metal lead wire 9 or core 40. However, for example, a metal lead wire or a core may be dipped into slurries 10 with a central axis in a horizontal position, in order to adhere to slurries 10 to the metal lead wire or the core, and to already formed layers.

Here, when the metal lead wire or the core is removed from the slurries in a horizontal position, the slurry adhering to the metal lead wire or the core may gravitate in a downward direction, and this makes it difficult to obtain a preform having concentric layers. However, for example, if the horizontally positioned metal lead wire or core is removed from the slurries while at the same time being rotated, the tendency of the adhering slurry to gravitate in a downward direction can be prevented.

Furthermore, in the method involving the metal lead wire or the core being dipped in slurries 10 in a horizontal position, it is not necessary to dip the metal lead wire or the core entirely in slurries 10 when forming the layers of the preform. Rather, slurries 10 may be adhered to the metal lead wire or the core by immersing only the upper-most layer already formed around the metal lead wire or the core. Here, the metal lead wire or the core is immersed and removed while being rotated.

(2) Organic Layer a) Positioning of the Organic Layer

In embodiment 2 above, an organic layer (varnish layer 20) is layered over metal lead wire 9 prior to the layering of first preform layer 211, although the organic layer may instead be formed prior to the layering of any of the other preform layers (i.e. layers 212–215). This structure also allows for the relieving of thermal stress occurring when the temperature is reduced to room temperature after preform 21 is sintered, and thus the occurrence of cracking can be prevented to a certain extent. However, because the contraction of preform 21 subsequent to the sintering process is greatest around the inner circumference of preform 21, forming the organic layer prior to first preform layer 211 as in embodiment 2 is considered to be the most effective way of preventing the occurrence of cracking.

In embodiment 2, the description only relates to the provision of a single organic layer between the metal lead wire and first preform layer 211. However, the provision of the organic layer is not limited to a single layer. Considering the sintering properties of the materials selected for the sealing plug and the metal lead wire, it is acceptable to provide organic layers prior to any of layers 211 to 215 of preform 21 being formed.

However, because of the space created by the burning-off of an organic layer in the binder elimination process, the provision of a large number of organic layers in preform 21 may cause a reduction in the cohesion of the sintered layers. Consequently, the number of organic layers must be determined appropriately in accordance with factors such as the number of sintered layers, as well as the size and materials (e.g. coefficient of linear expansion) used in the sealing plug.

b) Material of the Organic Layer

In embodiment 2, a varnish is used as the organic material of the organic layer, although any readily decomposable organic material may be used that allows the organic layer to decompose during the binder elimination process so as to create a space, examples of which include wax, starch, or the like. Furthermore, the slurry used to form the organic layer according to embodiment 2 does not include any of the components (e.g. metallic components) structuring the sealing plug, although as long as the organic layer decomposes in the binder elimination process to create a space within preform layer 11, the slurry may include small amounts of a powder of a metallic component structuring the sealing plug, or of a powder of another metal.

c) Thickness of the Organic Layer

In embodiment 2, varnish layer 20 is set to be approximately 5 $\mu$m in thickness. If varnish layer 20 is too thin, the space between the sealing plug and the metal lead wire will be insufficient to allow the preform to fully contract in a radial direction when the temperature is reduced after the sintering, and thus cracking may occur. Conversely, if varnish layer 20 is too thick, problems that may occur include a gap remaining between the sealing plug and the metal lead wire when the temperature is reduced after the sintering, and a gap being opened up between the sealing plug and the metal lead wire due to the expansion of the sealing plug and the metal lead wire when the temperature within arc tube 4 increases during the operation of high-pressure mercury lamp 1.

Consequently, the thickness of the organic layer preferably is set so that cracking does not occur around the inside of the sealing plug when the temperature is reduced to room temperature after the sintering, and also so that a gap is not opened up between the metal lead wire and the sealing plug or between any of the sintered layers of the sealing plug when the temperature of the metal lead wire, the arc tube, and the sealing plug increase during the operation of high-pressure mercury lamp 1. As a result, it is necessary to appropriately determine the thickness of the organic layer (or layers) based on the size (diameter) and coefficient of thermal expansion of the metal lead wire, the sealing plug, and the arc tube.

d) Related Matters

In embodiment 2 above, the description relates to the addition of an organic layer to the structure of embodiment 1, although the organic layer may also be included when core 40 is used as described in embodiment 4. However, because core 40 is also readily decomposable, it is necessary in this case to provide the organic layer between layers that are further away from core 40 than the first preform layer 211.

(3) Bonding Layer a) Position of the Bonding Layer

In embodiment 3 above, bonding layer 30 (i.e. a single bonding layer 30 being structured from alloy sintered layers 301, 303, and alumina sintered layer 302) is provided under first sintered layer 381 (i.e. between the metal lead wire and layer 381), although bonding layer 30 may instead be provided under any of the other sintered layers (i.e. layers 382~385).

Furthermore, in embodiment 3, the description relates to bonding layer 30 only being provided between the metal lead wire and first sintered layer 381, although the provision of bonding layer 30 is not limited to a single bonding layer, and bonding layers may be provided under any of sintered layers 381 to 385 of sealing plug 38.

Even if the number and positioning of bonding layers 30 differs from embodiment 3, the bonding layers function to strongly bond together the metal lead wire and first sintered layer 381, and whichever of the other sintered layers they may be provided between.

Here, with respect to the positioning of bonding layers 30, thermal stress arising from a difference in the coefficients of thermal expansion of individual layers when high temperatures are generated in arc tube 4 after high-pressure mercury lamp 1 is turned on, are greatest between metal lead wire 9 and the inner most layer of sealing plug 38, and thus exfoliation is most likely to occur therebetween. Consequently, it is considered most effective to at least provide a bonding layer between metal lead wire 9 and the inner most layer of sealing plug 38.

b) Material of the Alloy Sintered Layers of Bonding Layer 30

In embodiment 3, molybdenum powder (i.e. same material as that used for metal lead wire 9) is used as the powder of a third metallic material structuring alloy sintered layers 301 and 303 of bonding layer 30. However, it is possible to use, for example, a tungsten powder or a powder formed from a mixture of molybdenum and tungsten. The powder of other metallic materials may also be used, although in this case, the melting point of these other metallic materials must be higher than the melting point of manganese and also higher than the sintering temperature. This is to allow liquid phase sintering of the powder of the metallic material to occur during the sintering due to the manganese in alloy sintered layers 301 and 303.

c) Related Matters

In embodiment 3 above, the description relates to the addition of bonding layer 30 to the structure of embodiment 1, although the bonding layer may also be included when core 40 is used as described in embodiment 4. In this case, when, as in embodiment 4, the preliminary sintering is conducted in a nitrogen atmosphere at 700° C. for four hours, and, as in embodiment 1, metal lead wire 9 is passed through the hole created by the burning-off of core 40, and then, as in embodiment 3, the main sintering is conducted at 1600° C. for 30 minutes in a hydrogen atmosphere whose dew point has been adjusted to −5° C., it is possible to achieve a strong bond within the bonding layer and also between the metal lead wire and the bonding layer.

Furthermore, the variations of the bonding layer described in 3*a* and 3*b* above, can of course be applied to the use of core 40 as described in embodiment 4 to obtain the same effects.

(4) Metallic Layer

In bonding layer 30 of embodiment 3, molybdenum and manganese are used in alloy sintered layers 301 and 303, and alumina sintered layer 302 is formed as a glass layer. However, it is possible, for example, to provide a metallic layer instead of bonding layer 30, the metallic layer including a metallic material, such as manganese, having a lower melting point than both the metal lead wire and a third metallic material structuring at least one of the preform layers formed in a vicinity of the metal lead wire. Of course, bonding layer 30 and the metallic layer may be used in conjunction with one another.

Because of the liquid phase sintering due to the manganese that melts together the molybdenum in first preform layer 381 and the molybdenum in metal lead wire 9, it is also possible according to this structure to bond sealing plug 38 strongly to metal lead wire 9 via the metallic layer.

Here, as mentioned in embodiment 3 above, when the percentage of manganese in the metallic layer increases, there is a concern that the luminescence color of high-pressure mercury lamp 1 may change as a result of the manganese in alloy sintered layers 301 and 303 vaporizing when the temperature in arc tube 4 increases after high-pressure mercury lamp 1 is turned on. Because of this concern, the compounding rate of the manganese included in the metallic layer preferably, as in embodiment 3, is in a range of 1 wt % to 30 wt %. In this case, the metallic layer has the same structure as the alloy layers in bonding layer 30 according to embodiment 3.

a) Position and Number of Metallic layers

In the above example, as with the bonding layer in embodiment 3, the metallic layer is provided under first sintered layer 381 of sealing plug 38. However, the metallic layer may instead be provided under any of the other sintered layers (i.e. layer 382–385). Furthermore, the number of metallic layers is not limited to a single layer, and thus metallic layers may be provided under any of sintered layers 381 to 385 of sealing plug 38.

Because liquid phase sintering of the metallic layers occurs with the molybdenum in the preform layers sandwiching the metallic layers, it is also possible according to this structure to strongly bond the preform layers on either side of each metallic layer. Here, with respect to the positioning of the metallic layers, for the same reason given in 3-1 above, it is consider to be most effective to at least provide a metallic layer between metal lead wire 9 and the innermost layer of sealing plug 38.

b) Material of the Metallic layer and Melting Point of the Material

As described above for the metallic layer, molybdenum (melting point: approx.2620° C.) is used for the metal lead wire and for a fourth metallic material structuring at least one the preform layers formed in a vicinity of the metal lead wire, and manganese (melting point: approx.1244° C.) is used as a fifth metallic material having a lower melting point than that of the molybdenum. However, a material other than manganese may be used as the fifth metallic material. For example, when molybdenum or tungsten (melting point: approx.3380° C.) is used as the fourth metallic material, iron (melting point: approx.1535° C.), chromium (melting point: approx.1900° C.), or the like may be used as the fifth metallic material.

Given the high temperatures generated in arc tube 4 when high-pressure mercury lamp 1 is operated, the melting point of these fifth metallic materials preferably is higher than the temperature reached within arc tube 4 (may reach approx.900° C.). This is to prevent the melting of the fifth metallic material during the operation of lamp 1. Here, among the fifth metallic materials mentioned above, the wetting properties of manganese with metals such as molybdenum and tungsten is most favorable.

c) Related Matters

The variations described in 4*a* and 4*b* above are based on the structure of embodiment 1, although these variations may of course be applied to the use of core 40 described in embodiment 4.

(5) Sealing Plug a) Material of the Sealing Plug

In the above embodiments, description of the combinations (see FIG. 3) of molybdenum and silica as components structuring the sealing plug is premised on the provision of an arc tube made of quartz glass and a metal lead wire made of molybdenum. However, other combinations are possible. For example, if tungsten is used for the metal lead wire, then combinations of tungsten and silica may be used as components of the sealing plug, and if translucent alumina is used for arc tube 4 then combinations of tungsten and alumina or molybdenum and alumina may be used as components of the sealing plug.

Furthermore, it is not necessary for the sealing plug to be formed from combinations of the materials of metal lead wire 9 and arc tube 4. For example, it is possible to use molybdenum for the metal lead wire, and combinations of tungsten/silica or tungsten/alumina as the metallic components structuring the sealing plug, or furthermore, to use a mixture of the two materials molybdenum and tungsten as the metallic component structuring the sealing plug.

Furthermore, the sealing plug may be structured from materials other than molybdenum, tungsten, silica, or alumina. Needless to say, these other material must be able to withstand usage under the high temperatures generated in arc tube 4 when high-pressure mercury lamp 1 is operated.

Furthermore, given the difference in the coefficients of thermal expansion of arc tube 4 and metal lead wire 9 when high-pressure mercury lamp 1 is operated, it is preferable to structure the sealing plug from at least one metallic material whose coefficient of thermal expansion is closer to that of metal lead wire 9 than arc tube 4, and at least one metallic material whose coefficient of thermal expansion is closer to that of arc tube 4 than metal lead wire 9. Here, the sintering conditions of the preform naturally change when the materials structuring the sealing plug are varied.

b) Number of Layers in the Sealing Plug

In the above embodiments, description relates to the provision of a sealing plug having a five-layer structure. However, given that the layers of the sealing plug act to relieve the thermal stress arising from the difference in the coefficients of thermal expansion between metal lead wire 9 and arc tube 4, it is considered preferable to provide a sealing plug having as many layers as possible.

(6) Use of the Core a) Material of the Core

In embodiment 4 above, a wax is used for core 40, although basically the material used may be any readily decomposable organic material that decomposes in the binder elimination process so as to create a space, examples of which include starch, paper, or the like. Furthermore, core 40 does not include any of the components (e.g. metallic components) structuring sealing plug 48, although as long as core 40 decomposes in the binder elimination process to create a space within preform layer 41, core 40 may include small amounts of a powder of a metallic component structuring sealing plug 48, or of a powder of another metal.

b) Core Diameter

In embodiment 4, the diameter of core 40 is set to be greater than the diameter of metal lead wire 9. Here, if the difference between the diameter of core 40 and that of metal lead wire 9 is too small, cracking may occur as a result of the inner circumference of sealing plug 48 contacting with metal lead wire 9, and sealing plug 48 therefore not being able to contract in a radial direction when the temperature returns to room temperature after the sintering process. On the other hand, if the difference between the diameter of core 40 and that of metal lead wire 9 is too large, a gap may remain between sealing plug 48 and metal lead wire 9 when the temperature is reduced after the sintering, and a gap may also be opened up between sealing plug 48 and metal lead wire 9 due to the expansion of sealing plug 48 and metal lead wire 9 when temperatures increase within arc tube 4 during the operation of high-pressure mercury lamp 1.

Consequently, the diameter of core 40 preferable is set so that cracking does not occur around the inside of sealing plug 48 when the temperature returns to room temperature after the sintering, and also so that a gap is not opened up between sealing plug 48 and metal lead wire 9 or between the individual sintered layers of sealing plug 48 when the temperature of arc tube 4, metal lead wire 9, and sealing plug 48 rise during the operation of high-pressure mercury lamp 1.

For this reason it is necessary for the diameter of core 40 to be determined appropriately in accordance with the respective size (diameter) and coefficient of thermal expansion of arc tube 4, sealing plug 48, and metal lead wire 9.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A manufacturing method for a sealing plug used in sealing an arc tube, the sealing plug being formed by sintering a preform structured from a plurality of layers, the layers of the preform being layered around an outer circumference of a metal lead wire that supplies power to electrodes within the arc tube, so that the layers are substantially concentric with respect to the metal lead wire, comprising:

a slurry preparation step of preparing slurries used in forming the layers of the preform, the slurries corresponding one-to-one with the layers; and a preform manufacturing step of manufacturing the preform by dipping the metal lead wire into the slurry used to form an inner-most layer and drying the slurry adhering to the metal lead wire, and repeating the dipping and drying sequentially for the slurries used to form a second layer to an outer-most layer, wherein the slurry preparation step has the substep of:

preparing a slurry that includes a readily decomposable organic material, and the preform manufacturing step has the sub step of:

prior to forming at least one of the layers of the preform, forming an organic layer by dipping the metal lead wire into the slurry that includes the readily decomposable organic material, and drying the adhering slurry, and the organic layer becomes a gap layer after sintering.

2. The manufacturing method of claim 1, wherein the organic layer is formed prior to forming the inner-most layer of the preform.

3. The manufacturing method of claim 1, wherein the readily decomposable organic material is a varnish.

4. The manufacturing method of claim 1, wherein in the slurry preparation step, the slurries are prepared such that, of the plurality of layers structuring the preform, the closer a layer is to the metal lead wire, the closer a coefficient of thermal expansion of the layer is to a coefficient of thermal expansion of the metal lead wire, and the closer a layer is to the arc tube, the closer a coefficient of thermal expansion of the layer is to a coefficient of thermal expansion of the arc tube.

5. A manufacturing method for a sealing plug used in sealing an arc tube, the sealing plug being formed by sintering a preform structured from a plurality of layers, the layers of the preform being layered around an outer circumference of a metal lead wire that supplies power to electrodes within the arc tube, so that the layers are substantially concentric with respect to the metal lead wire, comprising:

a slurry preparation step of preparing slurries used in forming the layers of the preform, the slurries corresponding one-to-one with the layers and being prepared such that, of the plurality of layers structuring the preform, the closer a layer is to the metal lead wire, the closer a coefficient of thermal expansion of the layer is to a coefficient of thermal expansion of the metal lead wire, and the closer a layer is to the arc tube, the closer a coefficient of thermal expansion of the layer is to a coefficient of thermal expansion of the arc tube; and a preform manufacturing step of manufacturing the preform by dipping the metal lead wire into the slurry used to form an inner-most layer and drying the slurry adhering to the metal lead wire, and repeating the dipping and drying sequentially for the slurries used to form a second layer to an outer-most layer, wherein at least one of the slurries used to form layers of the preform in a vicinity of the metal lead wire includes a powder of a first metallic material whose coefficient of thermal expansion is closer to the coefficient of thermal expansion of the metal lead wire than the coefficient of thermal expansion of the arc tube, the slurry preparation step has the substep of:

preparing a slurry that includes a powder of a second metallic material whose melting point is lower than a melting point of both the metal lead wire and the first metallic material, the preform manufacturing step has the substep of:

prior to forming at least one of the layers of the preform, forming a metallic layer by dipping the metal lead wire into the slurry that includes the powder of the second metallic material, and drying the adhering slurry, and the sealing plug is formed by sintering the preform manufactured in the preform manufacturing step at a temperature that is higher than the melting point of the second metallic material, and lower than the melting point of both the metal lead wire and the first metallic material.

6. The manufacturing method of claim 5, wherein the metallic layer is formed prior to forming the inner-most layer of the preform.

7. The manufacturing method of claim 5, wherein the second metallic material is manganese.

8. A manufacturing method for a sealing plug used in sealing an arc tube, the sealing plug being formed by sintering a preform structured from a plurality of layers, the layers of the preform being layered around an outer circumference of a metal lead wire that supplies power to electrodes within the arc tube, so that the layers are substantially concentric with respect to the metal lead wire, comprising:

a slurry preparation step of preparing slurries used in forming the layers of the preform, the slurries corresponding one-to-one with the layers and being prepared such that, of the plurality of layers structuring the preform, the closer a layer is to the metal lead wire, the closer a coefficient of thermal expansion of the layer is to a coefficient of thermal expansion of the metal lead wire, and the closer a layer is to the arc tube, the closer a coefficient of thermal expansion of the layer is to a coefficient of thermal expansion of the arc tube; and a preform manufacturing step of manufacturing the preform by dipping the metal lead wire into the slurry used to form an inner-most layer and drying the slurry adhering to the metal lead wire, and repeating the dipping and drying sequentially for the slurries used to form a second layer to an outer-most layer, wherein at least one of the slurries used to form layers of the preform in a vicinity of the metal lead wire includes a powder of a metallic material whose coefficient of thermal expansion is closer to the coefficient of thermal expansion of the metal lead wire than the coefficient of thermal expansion of the arc tube;

the slurry preparation step has the substeps of:

preparing an alloy slurry that includes a manganese powder and a powder of at least one of the metallic material and a material used to form the metal lead wire; and preparing an alumina slurry that includes an alumina powder and a silica powder, the preform manufacturing step has a bonding layer formation substep of, prior to forming at least one of the layers of the preform, (i) forming a first alloy layer by dipping the metal lead wire into the alloy slurry and drying the adhering slurry, (ii) forming an alumina layer by dipping the metal lead wire on which the first alloy layer has been formed into the alumina slurry, and drying the adhering slurry, and (iii) forming a second alloy layer by dipping the metal lead wire on which the first alloy layer and the alumina layer have been formed into the alloy slurry, and drying the adhering slurry, and the sealing plug is formed by sintering the preform manufactured in the preform manufacturing step in a hydrogen atmosphere whose dew point is adjusted to be in a range of −20° C. to −5° C. inclusive, and at a temperature that is higher than a melting point of the manganese and lower than a melting point of both the metal lead wire and the metallic material.

9. The manufacturing method of claim 8, wherein the bonding layer substep is conducted prior to forming the inner-most layer of the preform.

10. The manufacturing method of claim 8, wherein the material used to form the metal lead wire is one of tungsten and molybdenum.

11. The manufacturing method of claim 8, wherein the metallic material powder includes at least one of a tungsten powder and a molybdenum powder.

12. The manufacturing method of claim 8, wherein in the slurry preparation step, the manganese is included in a range of 1 wt % to 30 wt % inclusive of the alloy slurry, and the silica is included in a range of 1 wt % to 5 wt % inclusive of the alumina slurry.

13. A manufacturing method for a sealing plug used in sealing an arc tube, the sealing plug being formed from a plurality of sintered layers made of different components, the sintered layers being layered around an outer circumference of a metal lead wire, so that the layers are substantially concentric with respect to the metal lead wire, comprising:

a slurry preparation step of preparing slurries that include the sintered layer components for each layer of the sealing plug;

a preform manufacturing step of manufacturing a preform by dipping a core, which is substantially the same shape as the metal lead wire, into the slurry used to form an inner-most layer and drying the slurry adhering to the core, and repeating the dipping and drying sequentially for the slurries used to form a second layer to an outer-most layer;

a preliminary sintering step of sintering the preform and burning-off the core by pyrolysis; and a main sintering step of inserting the metal lead wire in a space created by the burning-off of the core, and sintering the preliminarily sintered preform, so as to bond together the metal lead wire and the preform.

14. The manufacturing method of claim 13, wherein in the preform manufacturing step, the core is dipped into and removed from the slurries with a central axis of the core positioned perpendicular to a surface of the slurries.

15. The manufacturing method of claim 13, further comprising:

a cutting-off step of cutting-off a tip of a lower section of the preform formed in the preform manufacturing step, so that the core is exposed.

16. The manufacturing method of claim 13, wherein the core is made of a readily decomposable organic material.

17. The manufacturing method of claim 16, wherein the sintered layer components included in each of the slurries are adjusted such that, of the plurality of layers structuring the preform, the closer a layer is to the metal lead wire, the closer a coefficient of thermal expansion of the sealing plug is to a coefficient of thermal expansion of the metal lead wire, and the closer a layer is to the arc tube, the closer the coefficient of thermal expansion of the sealing plug is to a coefficient of thermal expansion of the arc tube.

* * * * *